US005432973A

United States Patent [19]

Wagner et al.

[11] Patent Number: 5,432,973

[45] Date of Patent: Jul. 18, 1995

[54] ERASER SYSTEM FOR STUBBORN DRY ERASE MARKS

[75] Inventors: Michael J. Wagner, Carol Stream; Rodney J. Baudino, Woodridge, both of Ill.

[73] Assignee: Sanford Corporation, Bellwood, Ill.

[21] Appl. No.: 176,963

[22] Filed: Jan. 3, 1994

[51] Int. Cl.[6] ..... A47L 25/00; B43L 21/00

[52] U.S. Cl. ..... 15/210.1; 15/105; 15/118; 15/143.1; 15/223; 401/52; 401/195

[58] Field of Search ..... 15/105, 105.51, 105.52, 15/114, 118, 143.1, 210.1, 223, 224, 424, 425; 401/52, 195

[56] References Cited

U.S. PATENT DOCUMENTS

| | | | |
|---|---|---|---|
| 646,824 | 4/1900 | Gerry | 15/118 |
| 1,690,134 | 11/1928 | Schmidt et al. | 15/118 |
| 1,825,858 | 10/1931 | Elnett | 15/223 |
| 1,928,230 | 9/1933 | Reynolds | 15/223 |
| 1,942,205 | 1/1934 | Elnett | 15/223 |
| 3,110,917 | 11/1963 | McPeek, Jr. | 401/52 |
| 3,418,673 | 12/1968 | Kruth | 15/118 |
| 3,986,224 | 10/1976 | Yang | 15/224 |
| 5,072,483 | 12/1991 | Durand | 15/105.51 |

FOREIGN PATENT DOCUMENTS

| | | | |
|---|---|---|---|
| 2635050 | 2/1990 | France | 15/210.1 |
| 1139009 | 1/1969 | United Kingdom | 15/118 |

*Primary Examiner*—Mark Spisich
*Attorney, Agent, or Firm*—Baker & McKenzie

[57] ABSTRACT

A combined eraser and marker product which comprise an eraser system especially adapted for erasing stubborn dry erase marks on white boards having a first erasing medium for removing recently applied markings, such as a pile fabric, and a second erasing medium for removing stubborn dry erase marks, such as Velcro, the eraser further having storage capacity for up to three markers.

13 Claims, 1 Drawing Sheet

ERASER SYSTEM FOR STUBBORN DRY ERASE MARKS

This invention relates generally to erasers, and a combined eraser and marker product which comprise an eraser system. In all embodiments it relates specifically to an eraser which is especially adapted for erasing stubborn dry erase marks on white boards.

BACKGROUND OF THE INVENTION

Dry markers used on white boards have become increasingly popular in recent years. Such markers are well developed and are currently available in a wide variety of colors, though black is the color most commonly used. Such markers are usually used in conjunction with dry erase boards which have a relatively smooth, non-porous surface so that the marker fluid does not sink into the body of the board to the same degree chalk sinks into a conventional slate blackboard. Such dry boards are also well-known in the art and hence a detailed description of the dry boards is not necessary to an understanding of the invention. Such boards are available in many colors but white is by far the most common color since it provides maximum or near maximum contrast with the marker fluid, particularly black fluid.

Although the marker and board described above are very popular, certain drawbacks have become apparent which pose a nuisance to users.

A significant problem is the fact that it is difficult to remove the markings made by such markers on a dry board if the markings have been on the dry board for a substantial length of time. It will be understood that dry board erasers are available which function very well in removing markings which are fresh from a dry board. Thus, for example, if a teacher uses the above-described marker and board to illustrate a lecture, the board may be covered with markings before the lecture is finished. When this occurs the lecturer simply erases the markings made earlier in the lecture using a conventional dry board eraser and thereby re-creates a clear area on the board, and then begins to re-mark said clear area as the lecture continues. The markings made just moments ago, and other markings made up to a considerably longer period of time such as, for example, during the preceding lecture hour, erase easily with an eraser having a conventional dry board erasing surface. However, when the markings have been on the dry board for an extended period of time, say, for example, over a holiday or during a school closed period of several weeks or several months, the markings which remain from the last use can be removed using a conventional eraser only with great difficulty and with the application of repeated wiping passes under substantial hand-applied pressure. On occasion, even the application of the above-described effort does not result in a clear surface and hence the next user must work with a surface having faint, and possibly not so faint, traces of the markings made by a prior user. The possibility for confusion is obvious.

Prior markings which have been in place on a dry board for a substantial period of time are commonly referred to as stubborn dry erase marks, and that phrase will be used in this description and the accompanying claims to describe such markings.

SUMMARY OF THE INVENTION

The invention is directed to an eraser particularly well adapted to quickly and easily remove stubborn dry erase marks from marker boards while, at the same time, having the ability to quickly and easily remove fresh marks to the same extent as conventional erasers do. The invention is also directed to such an eraser which can be used by itself and without any accompanying components, and, equally well, to an eraser which can hold one or a plurality of markers so that the user can manipulate the eraser and the marker or markers as a unit, and change from one marker to another marker of different color quickly, thereby avoiding a disconcerting and attention-interrupting break in presentation by the dry board user.

The eraser in the (a) eraser, and (b) eraser and marker combination includes a first erasing medium which is particularly well adapted for removing recently applied markings from the dry erase board with which this invention is intended to be used, and a second erasing medium which is particularly well adapted to erase stubborn dry erase marks. Although different materials may be used for each of the above-described erasing mediums, it is preferred that the first erasing medium be a pile fabric, and the second erasing medium be velcro, and preferably a closed loop Velcro.

It is also a feature of the invention that the eraser framework be so arranged that it may be conveniently grasped by a user when no markers are associated with the eraser, and equally easily grasped by a user when one on up to the full storage capacity of the eraser are assembled to the eraser.

DESCRIPTION OF THE DRAWING

The invention is illustrated more or less diagrammatically in the accompanying drawing in which.

DESCRIPTION OF A SPECIFIC EMBODIMENT

Figure 1:
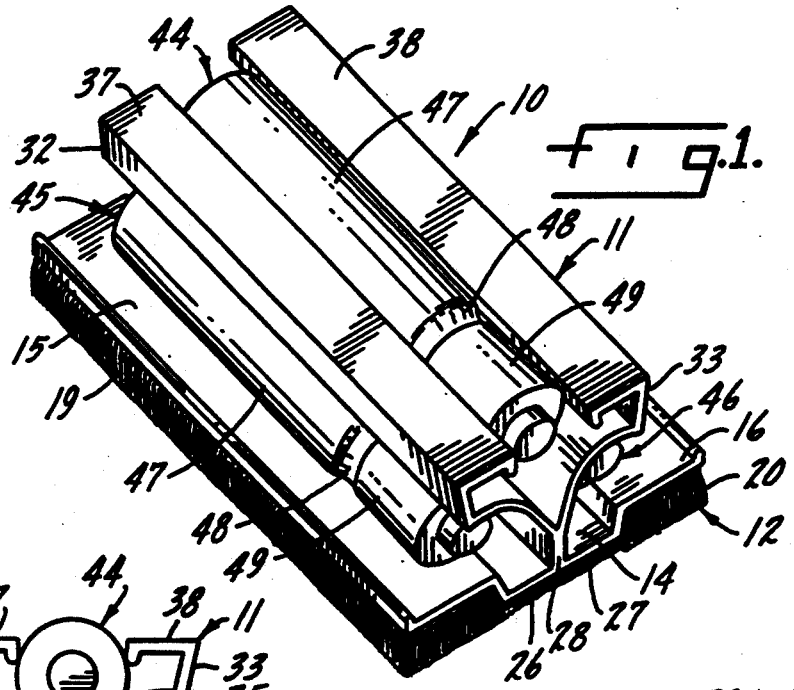
FIG. 1 is a perspective view of the eraser system for stubborn dry eraser marks of this invention with, in this instance, three markers associated therewith.

Like reference numerals will be used to refer to like or similar components from Figure to Figure in the drawing.

Figure 2:
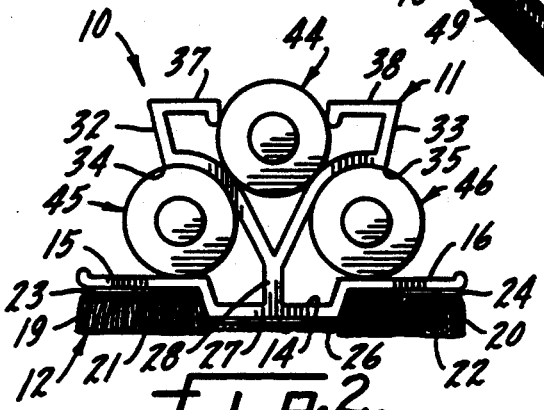
FIG. 2 is a right end view.

The eraser system of this invention is indicated generally at 10 in FIGS. 1 and 2. The eraser consists essentially of two parts, a framework, indicated generally at in FIGS. 1, 2 and 3, and the erasing medium, indicated generally at 12 in the Figures.

The framework 11 is, in this instance, a unitary piece having constant dimensions from end to end so that it lends itself to economical production processes, such as plastic extrusion techniques.

Figure 3:
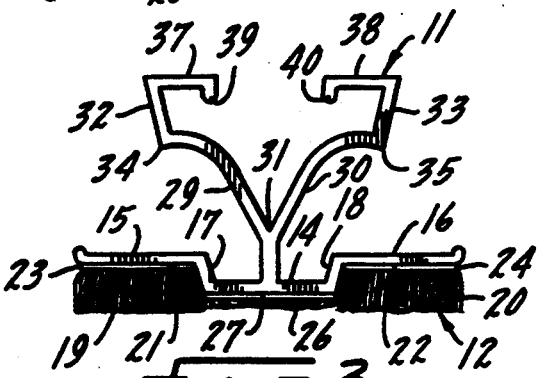
FIG. 3 is an end view of the eraser.
Figure 4:
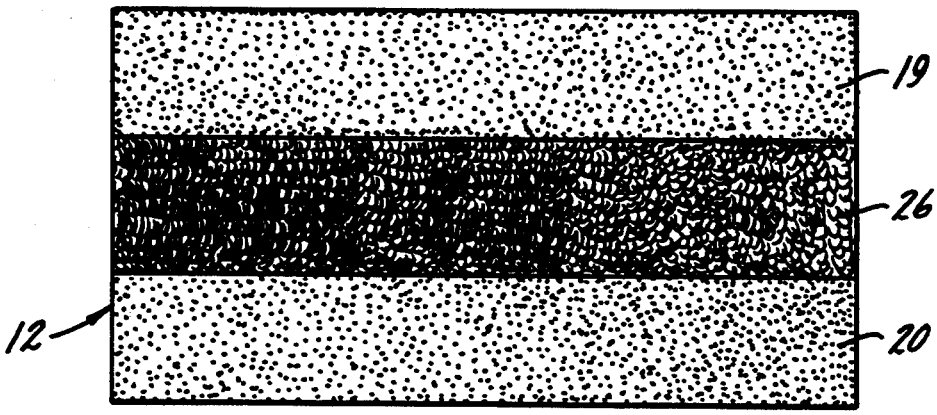
FIG. 4 is a bottom view of the eraser.

The lower portion of framework 11 has three distinct sections comprising a center section 14 and two side sections 15 and 16 which are illustrated best in FIGS. 1, 2 and 3. As best seen in FIG. 3, the two side sections 15 and 16 are disposed at the same level and the center section 14 is offset downwardly therefrom by means of upwardly and outwardly inclined wall portions 17 and 18. The lower portion forms, in effect, a base to which the erasing medium is secured.

The erasing medium consists of two strips of pile fabric, indicated at 19, 20, of a width which conforms to and depends downwardly from the securement areas 21, 22 formed on the undersurface of side sections 15, 16 respectively. The strips of pile fabric are secured to their associated surfaces by a carrier indicated at 23, 24 respectively. Preferably the carrier is an adhesive having the property of being able to form a bond strong enough to withstand the substantial pressures to which the eraser is subjected when in use throughout the entire useful life of the eraser, and capable of forming such a bond with both the material of which the framework is composed, which is preferably plastic, and the conventional pile fabric backing. The pile fabric may for example be polypropylene fabric in the form which is used in carpeting and other products such as paint rollers. One suitable carrier material is a clear adhesive available from the 3M Company under the trade designation 8056 Adhesive Systems. Said carrier is applied in an amount to form a strong bond and may for example have a thickness of on the order of about 1/32 inch. The pile fabric may, for example, have a thickness of on the order of about ¼ inch.

The erasing medium further includes a strip 26 of the plastic material commonly known as Velcro. Both cut loop and closed loop Velcro is available but the closed loop form is used because of its stiffness and better mark removing capability. The Velcro is attached to the undersurface of the center section 14 of the framework by a suitable carrier, indicated at 27, which carrier may be the same as the carrier material 23, 24 since Velcro is a plastic material.

From FIGS. 2 and 3 it will be noted that the pile fabric preferably extends downwardly a short distance further than the Velcro, said distance being, for example, on the order of about 1/32 inch.

The upper portion of the framework has roughly the shape of the letter Y and consists of a vertical stem 28 and two diverging arm portions 29, 30 which diverge (or join) at junction 31. Each arm portion terminates in an upwardly and outwardly inclined wall 32, 33, each wall forming a sharp junction with its associated arm at 34, 35, respectively for a purpose which will appear hereinafter. It will be noted that that portion of the arm portions 29, 30 which are closely adjacent to their associated walls 32, 33 are formed with a slight reverse curve so that the arm-wall junctions 34, 35 are closer to the upper surface of their associated side sections 15, 16 than the area immediately inwardly from said arm-wall junctions 34, 35.

Each wall 32, 33 terminates in an inwardly extending section 37, 38 which, in this instance, is horizontally disposed. Each inwardly extending section 37, 38 in turn terminates in a downwardly extending edge lip 39, 40 though this specific configuration may be varied as will appear hereinafter.

Since the entire framework is formed of plastic and the thickness of the various components may be only on the order of about 1/16 inch, it will be appreciated that the components, though fixed in position to one another in an unstressed condition, are not absolutely rigid. Specifically, they have the capability of flexing to a slight degree toward and away from one another under urging in a deforming direction by modest hand applied pressure. The plastic material from which the framework is composed has a memory so that once deformed by external pressure the components will tend to return to their initial, unstressed position.

Referring now to FIGS. 1 and 2, and initially to FIG. 2, the combination of an eraser and a maximum of three markers are shown. As can be best appreciated from FIG. 2, any one or all of markers 44, 45 or 46, or any combination thereof, may be assembled to the framework 11 to thereby form a combined eraser-marker system 10. The exact configuration of the markers is not an essential feature of the invention so long as at least one lineal area is capable of being assembled to the eraser.

In order to enable a marker to be received and securely held to the framework 11, certain spatial relationships must be present.

Specifically, to hold marker 45 between the upper surface of the left side section 15 of the bottom of the framework and left arm 29 of the Y section of the framework, the distance between left arm-wall junction 34 and the upper surface of left side section 15 will be slightly shorter than the vertical diameter of the marker 45. Since the vertical distance between arm-wall junction 34 and left side section 15 lies to the left of the vertical diameter of marker 45 and said vertical distance is less than the vertical distance of marker 45, the marker 45 will be positively mechanically gripped between the Y section and the left side section 15 of the framework. In effect, at least a three point support for the marker has been provided with at least two of the three support or contact points between the framework and the marker lying on opposite sides of a diametrical line of the marker, with at least one contact point on each side of the diametrical line.

Similar functions exist with respect to the right side of the eraser when marker 46 is inserted in its indicated position. In essence, the inherent resiliency of the plastic material from which the Y arm portions 29, 30 are formed enable said Y arms 29, 30, to swing upwardly toward a 12:00 position whenever a marker is inserted in the pocket area formed between the underside of a Y arm 29, 30 and the upper side of a side section 15, 16.

When a marker 44 is inserted into the top center of the Y section above junction 31, the planar walls 32, 33 will flex outwardly to thereby allow the marker 44 to pass through the horizontal space between edge lips 39, 40 until the marker abuts the upper inside surface of Y arm portions 29, 30 as illustrated in FIG. 2. Since the distance between the contact points of the edge lips 39, 40 is less than the horizontal diameter of marker 44, and since said distance is above said horizontal diameter, the marker will be positively, mechanically gripped by the super structure defined by walls 32, 33, inner wall sections 37, 38 and edge lips 39, 40. It will be understood that when three markers are assembled to the framework 11, the inwardly extending sections 37, 38 will be sprung slightly upwardly as well as outwardly. Each of the three marker receiving portions of the framework—left arm 29 and left side 15, right arm 30 and right side 16, and arms 29, 30 together with lips 39,40—form in effect a gripping receptacle for a marker.

Referring now to FIG. 1, a specific example of a marker of a definite configuration is there illustrated. In this showing the markers indicated generally at 44, 45 and 46 are each formed with a main cylindrical portion 47 of constant diameter which terminates at one end in a short section of reduced diameter 48 which abuts against a cap 49. The maximum diameter of cap 49 is shown, in this instance, as equal to the diameter of the cylindrical portion 47 and hence the maximum diametrical area of the cap deflects the Y portion of the framework to the same extent and in the same manner as does the cylindrical portion 47. However, it will be appreciated that it is possible that the maximum diameter of the cap may be larger or smaller than the diameter of the main cylindrical section 47. If the cap has a maximum diameter larger than the diameter of cylindrical portion 47, the only, or primary, holding force between the framework and the marker or markers will occur at the contact points between the framework and said maximum diameter of the cap. If the cap has a maximum diameter smaller than the cylindrical portion 47, the primary, and probably only, holding force between the framework and marker or markers will occur between the cylindrical portion 47 and the framework.

It will thus be seen that the eraser structure is very flexible in terms of accommodating markers of different lengths and exterior configurations.

In use, a user grasps the framework of the eraser together with either one, two or three markers, if present, in one hand and wipes the dry board containing markings with the usual arm-hand generated strokes.

The pile fabric strips 19, 20 will effectively remove markings which have not dried so long and so hard as to be characterized as stubborn dry erase marks. The exposed surface of Velcro strip 26 may make contact with the dry erase board and contribute to the erasing action, but the primary mark erasing portion of the eraser system will be the pile fabric strips 19, 20; indeed, they may remove all the non-stubborn markings. In essence, the Velcro strip need not be fully activated if no stubborn dry erase marks are to be removed, with the phrase not fully activated including all degrees of activation from no activation up to nearly complete activation.

When stubborn dry erase markings are encountered the user applies sufficient pressure to cause the Velcro strip 26 to come into contact with the dry erase board. Since the individual loops which form the Velcro strip are much stiffer and harder than the soft, carpet-like consistency of the pile fabric strips 19, 20, the pile fabric strips will be readily compressed and, at their edges, forced outwardly so that the coarse, harder Velcro fibers readily engage the board's surface. As a consequence, the heavier scraping action derived from the Velcro loops will be applied instantly to the board to bring maximum scrubbing/erasing pressure to bear on the stubborn dry erase marks. Any marking material which is dislodged from the surface of the dry erase board and which is not picked up by the Velcro will be trapped by the softer, pile fabric strips 19, 20.

It will thus be seen that an eraser system, and specifically an eraser or an eraser in combination with one or a plurality of markers, has been disclosed which functions to effectively remove both recently applied markings on dry erase boards and stubborn dry erase markings.

Although a specific embodiment of the invention has been illustrated and described it will at once be apparent to those skilled in the art that various modifications and variations may be made within the spirit and scope of the invention. Accordingly, it is intended that the scope of the invention be limited solely by the hereafter appended claims when interpreted in light of the relevant prior art, and not according to the specific disclosures set forth hereinabove.

We claim:

1. An eraser for stubborn dry erase marks, said eraser including a framework, said framework including a base portion adapted to receive an erasing medium, said base portion having first and second opposite surfaces, said framework further including a portion of lesser width than the base portion projecting upwardly from the first surface of the base portion and contoured to be grasped in the hand of a user, and an erasing medium carried by the second surface of the base portion, said erasing medium including a first erasing medium of soft flexible material which is capable of removing and holding marking fluid which has recently been applied to a marking surface and a second erasing medium which is harder and stiffer than said first erasing medium, said second erasing medium being capable of removing stubborn dry erase marks, said first erasing medium being a pile fabric, and said second erasing medium being a material selected from the group consisting of hook and loop material.

2. The eraser of claim 1 further characterized in that the second erasing medium is a closed loop material.

3. An eraser for stubborn dry erase marks, said eraser including a framework, said framework including a base portion adapted to receive an erasing medium, said base portion having first and second opposite surfaces, said framework further including a portion of lesser width than the base portion projecting upwardly from the first surface of the base portion and contoured to be grasped in the hand of a user, and an erasing medium carried by the second surface of the base portion, said erasing medium including a first erasing medium of soft flexible material which is capable of removing and holding marking fluid which has recently been applied to a marking surface and a second erasing medium which is harder and stiffer than said first erasing medium, said second erasing medium being capable of removing stubborn dry erase marks, said second erasing medium being located between separate areas of said first erasing medium, said first erasing medium, in an inoperative unstressed condition, extending downwardly from the second surface of the base portion of the framework a slightly greater distance than the second erasing medium whereby, if only said first, soft erasing medium is required to remove markings, said second erasing medium need not be fully activated, said first erasing medium being a pile fabric and said second erasing medium being a material selected from the group consisting of hook and loop material.

4. An eraser system for stubborn dry erase marks, said eraser system including a framework said framework including a base portion adapted to receive an erasing medium, said base portion having first and second opposite surfaces, an erasing medium carried by the second surface of the base portion, said erasing medium including a first erasing medium of soft flexible material which is capable of removing and holding marking fluid which has recently been applied to a marking surface and a second erasing medium which is harder and stiffer than said first erasing medium, said second erasing medium being capable of removing stubborn dry erase marks, said framework further including a portion projecting upwardly from the first surface of the base portion and contoured to be grasped in the hand of a user, said upwardly projecting portion defining, with another portion of the framework, a gripping receptacle adapted to receive and hold at least one marker whereby the eraser and marker can be grasped and used as a unitary structure, said upwardly projecting portion being generally Y shaped, at least one arm portion of the Y overlying one side of the base portion, the underside of the said one arm portion and the first surface of the portion being contoured to make contact with a marker assembled thereto at at least three contact points, at least two of which lie on opposite sides of a diametrical line of the marker.

5. The eraser system of claim 4 further characterized in that each arm portion of the Y overlies an associated side of the base portion, the underside of each arm portion and its associated side of the base portion being contoured to make contact with a marker assembled thereto at at least three contact points, at least two of which lie on opposite sides of a diametrical line of the marker.

6. The eraser system of claim 5 further characterized in that the arm portions of the Y form a seat for the reception of a third marker, and means for positively mechanically gripping the third marker.

7. The eraser system of claim 6 further characterized in that the framework is a unitary, one-piece structure formed from a solid flexible material which may be slightly resiliently deformed when a marker is assembled thereto.

8. The eraser system of claim 7 further characterized in that the first erasing medium is a pile fabric, and the second erasing medium is a material selected from the group consisting of hook and loop material.

9. The eraser system of claim 8 further characterized in that the second erasing medium is a closed loop material.

10. The eraser system of claim 9 further characterized in that said first erasing medium, in an inoperative unstressed condition, extends downward from the second surface of the base portion of the framework a slightly greater distance than the second erasing medium whereby, if only said first, soft erasing medium is required to remove markings, said second erasing medium need not be fully activated.

11. An eraser for stubborn dry erase marks, said eraser including a framework, said framework including, firstly, a base having a top and bottom side, said framework including, secondly, an upper portion projecting upwardly from the top side of the base and contoured to be grasped in the hand of the user, and an erasing medium carried by the bottom side of the base, said erasing medium including a first erasing medium of soft flexible material which is capable of removing and holding marking fluid which has recently been applied to a marking surface and, a second erasing medium which is harder and stiffer than the first erasing medium, said first erasing medium being a pile fabric, said second erasing medium being a material selected from the group consisting of hook and loop material.

12. The eraser of claim 11 further characterized in that that portion of the bottom side of the framework which carries the second, erasing medium is located closer to the marking surface carrying dry erase marks when in use than is that portion of the bottom side of the framework which carries the first erasing medium of soft flexible material.

13. An eraser system for stubborn, dry erase marks, said eraser system including a framework, said framework including, firstly, an elongated base having a top and bottom side, said framework including, secondly, an elongated upper portion projecting upwardly from the top side of the base, said upper portion having means for receiving and gripping at least one marker, said means for receiving and gripping said at least one marker defining a gripping surface extending along at least a portion of the length of said base whereby it is effective to grip a marker at substantially all locations along the upper portion, said upper portion being contoured to be grasped in the hand of a user, and operated by said user, both in the presence and in the absence of a marker gripped in said upper portion, and an erasing medium carried by the bottom side of the base, said erasing medium including a first erasing medium of soft flexible material which is capable of removing and holding marking fluid which has recently been applied to a marking surface, and a second erasing medium which is harder and stiffer than the first erasing medium, said second erasing medium being capable of removing stubborn dry erase marks.

* * * * *